US005203726A

United States Patent [19]

Quinn

[11] Patent Number: 5,203,726

[45] Date of Patent: Apr. 20, 1993

[54] INSULATED ELECTRICAL TERMINAL AND METHOD OF FABRICATING SAME

[75] Inventor: Robert L. Quinn, St. Petersburg, Fla.

[73] Assignee: Molex Incorporated, Lisle, Ill.

[21] Appl. No.: 834,019

[22] Filed: Feb. 11, 1992

[51] Int. Cl.[5] ..... H01R 4/20

[52] U.S. Cl. ..... 439/867; 439/879

[58] Field of Search ..... 439/879, 881, 865-868

[56] References Cited

U.S. PATENT DOCUMENTS

| | | | |
|---|---|---|---|
| 2,815,497 | 12/1957 | Redslob | 439/879 |
| 3,521,224 | 7/1970 | Spooren | 439/879 |
| 4,214,361 | 7/1980 | Coldren et al. | 29/863 |
| 4,298,243 | 11/1981 | Swengel, Jr. et al. | 439/881 |
| 4,348,070 | 9/1982 | Simon | 339/59 R |
| 4,771,538 | 8/1988 | O'Loughlin et al. | 29/874 |

FOREIGN PATENT DOCUMENTS

| | | | |
|---|---|---|---|
| 1209089 | 10/1970 | United Kingdom | 439/865 |

OTHER PUBLICATIONS

Thomas & Betts Catalog pp. 7 and 10 Copyright 1978.
Mar. 1990 AMP Catalog p. 1.

*Primary Examiner*—Gary F. Paumen

*Attorney, Agent, or Firm*—A. A. Tirva; Stacey Caldwell Scheer

[57] ABSTRACT

An insulated terminal is disclosed for connection to the end of an insulated electrical wire having an exposed end of the conductor core projecting from the wire insulation. An angled insulating housing is provided with a through passage having a first passage portion communicating with and at an angle to a second passage portion. The first passage portion includes an open end for receiving a complementary mating terminal, and the second passage portion includes an open end for receiving the insulated electrical wire. A terminal is positioned into the first passage portion through the open end thereof. The terminal includes an outward contact section for connection to the mating terminal and an inward crimp section communicating with the second passage portion for crimping onto the conductor core of the insulated electrical wire inserted into the second passage portion. A crimp ferrule is positioned into the second passage portion in alignment with the crimp section for crimping onto the insulation of the insulated electrical wire. The invention contemplates a method of fabricating a fully insulated terminal according to the above, along with crimping the crimp section onto the conductor core and crimping the crimp ferrule onto the wire insulation in a single operation.

11 Claims, 2 Drawing Sheets

INSULATED ELECTRICAL TERMINAL AND METHOD OF FABRICATING SAME

FIELD OF THE INVENTION

This invention generally relates to the art of electrical connectors and, particularly, to insulated electrical terminals of the type having a for connection to the end of an insulated electrical wire and an insulating housing which contains the terminal and a portion of the wire.

BACKGROUND OF THE INVENTION

Insulated electrical terminals of the type described generally above, and in detail herein, include a tubular end portion, commonly referred to as a ferrule, which may be placed over the stripped end of an insulated electrical wire containing a solid or stranded conductor core therein. The ferrule may be crimped mechanically and electrically to the stripped core end of the wire. The other end of the terminal typically includes a terminal tongue. The tongue may be formed as a receptacle having a generally planar portion and curled flanges extending from the edges of the planar portion. The tongue receives a flat blade-type terminal of a complementary mating connecting device. Such insulated terminals originally attained wide use in the appliance and automotive industries which often had generally standard blade or tab terminals. However, the terminals now have been used in a wide variety of other applications.

Originally, insulated terminals of the character described above were used primarily in a straight line configuration between the electrical wire and the electrical device to which it is terminated. The ferrule was at one end of an elongated member and the terminal end at the other. However, various industries have found a need to make connections to termination portions on an electrical device, with the wire being introduced at some angle to the electrical device, typically at a 90° angle. Although the electrical wire, itself, can be bent in order to make such connections, the total length consisting of the tongue configuration plus the length of the ferrule, plus the length of the bend of wire can in may applications be too long. Consequently, such insulated terminals have been designed in an angled configuration with the ferrule width, not length, being added to the tongue configuration, i.e. the exposed conductor is inserted into the ferrule at approximately a 90 , rather than a 180 offset from the mating blade-type terminal. This reduces the overall length of the connector by the bend of wire and the difference between the length and width of the crimp ferrule. Such insulated terminals commonly are called "flag" terminals.

One of the problems with such insulated terminals, particularly flag-type terminals, involves the provision of strain relief on the insulated electrical wire itself. In other words, although the conductor core of the wire is crimped to the terminal inside the insulating housing, in certain environments the conductor core may flex and possibly break if the movement is not restrained. This condition may be particularly prevalent in high vibration environments such as automotive applications. Other applications where these problems are encountered may include aircraft, railroad, appliance and environments involving electric motors.

In high vibration environments such as those described above, crimping means have been provided to crimp or clamp onto the outer insulation of the insulated electrical wire to relieve the strain on the conductor core of the electrical wire. In a right angle or "flag" terminal, heretofore it has been common to leave one side of the insulating housing open for insertion of the terminated wire after the crimping operation. However, in high vibration environments, an open side of the insulated terminal is undesirable due to the possibility of shock or shorts or other dangers caused by uninsulated terminals with an exposed voltage potential.

Another type of crimping operation involves the use of a crimped ferrule for the conductor core of the insulated wire, with the ferrule preassembled into the insulated housing before crimping. If strain relief on the insulated wire, itself, is desired, a second crimp ferrule for the wire insulation has been added, but without full insulation protection of the housing. The second insulation crimping ferrule also may contribute to a larger overall connector, and space often is at a premium to the user of insulated terminals of the flag configuration.

This invention is directed to solving the myriad of problems discussed above by providing a low profile angled or flag terminal which is fully insulated and which includes an insulation gripping strain relief means to prevent breakage of the conductor core of an insulated electrical wire in a high vibration environment.

SUMMARY OF THE INVENTION

An object, therefore, of the invention is to provide a new and improved insulated terminal of the character described, particularly a flag-type terminal, and particularly including strain relief means on the insulated portion of an insulated electrical wire.

Another object of the invention is to provide a method of fabricating an insulated terminal of the character described.

The invention is disclosed in an insulated terminal for connection to the end of an insulated electrical wire having a stripped or exposed end of the conductor core projecting from the wire insulation. An angled insulating housing has a through passage with "a first passage portion communicating with and at an angle to a second passage portion. The first passage portion includes an open end for receiving a complementary mating terminal, and the second passage portion includes an open end for receiving the insulated electrical wire. A terminal is positioned into the first passage portion through the open end thereof. The terminal includes an outward contact section for connection to the mating blade terminal and an inward crimp section for crimping onto the conductor core of the insulated electrical wire inserted into the second passage portion. The invention contemplates a crimp ferrule positioned into the second passage portion for crimping onto the insulation of the insulated electrical wire.

In the exemplary embodiment of the invention, generally, complementary interengaging means are provided between the crimp ferrule for the wire insulation and the crimp section of the terminal,.for the, conductor core, to fix the crimp ferrule to the crimp section and maintain them in a fixed condition in response to crimping at least one of the crimp ferrule or the crimp section. More specifically, the complementary interengaging means are provided in the form of telescoped portions of the crimp ferrule and the crimp section. The crimp ferrule and the crimp section are disclosed as being generally tubular.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
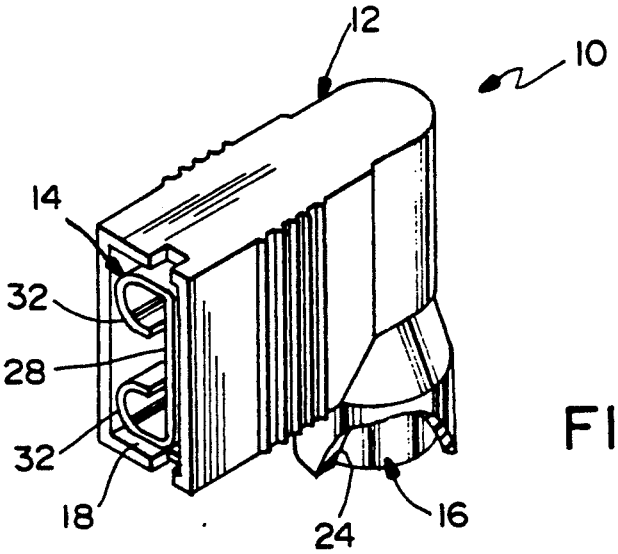
FIG. 1 is a perspective view of the terminal according to the invention partly in section to show the insulation grip ferrule.

Referring to the drawings in greater detail and first to FIG. 1, the invention is disclosed herein as embodied in an insulated terminal generally designated 10, for connection to the end of a conventional insulated electrical wire (not shown). Suffice it to say, the insulated electrical wire has a stripped or exposed end of a conductor core projecting from the wire insulation, as is well known in the art. Generally, insulated terminal 10 includes an angled insulating housing, generally designated 12. The housing mounts therewithin, substantially surrounding and insulating an angled terminal, generally designated 14, and a crimp ferrule, generally designated 16.

Figure 2:
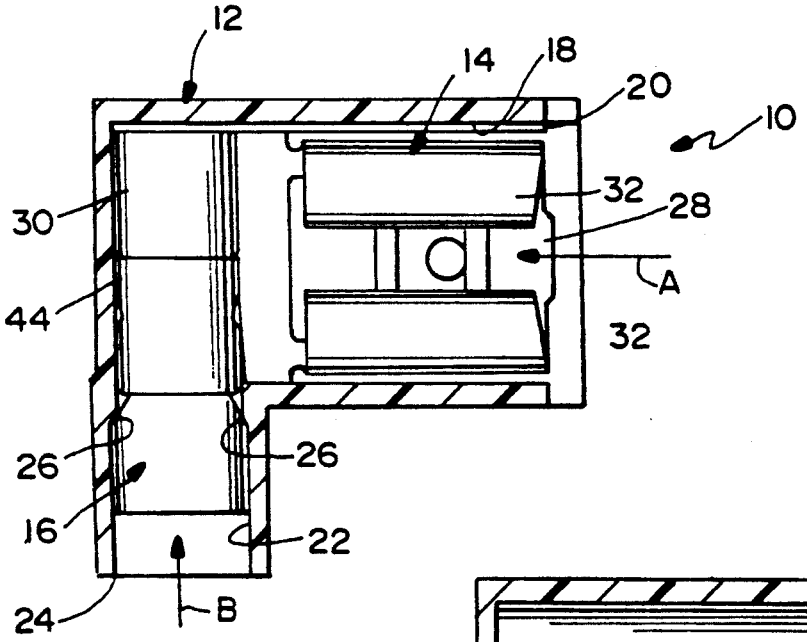
FIG. 2 is a central sectional view through an insulated terminal embodying the concepts of the invention.

It can be seen in FIGS. 1 and 2 that the entire configuration of housing 12, terminal 14 and crimped ferrule 16 is a right-angled configuration to provide a "flag" terminal. In other words, a complementary mating terminal will be inserted in the direction of arrow "A", and the insulated electrical wire will be inserted in the direction of arrow "B" at approximately 90° to the insertion direction of the mating terminal.

Figure 3:
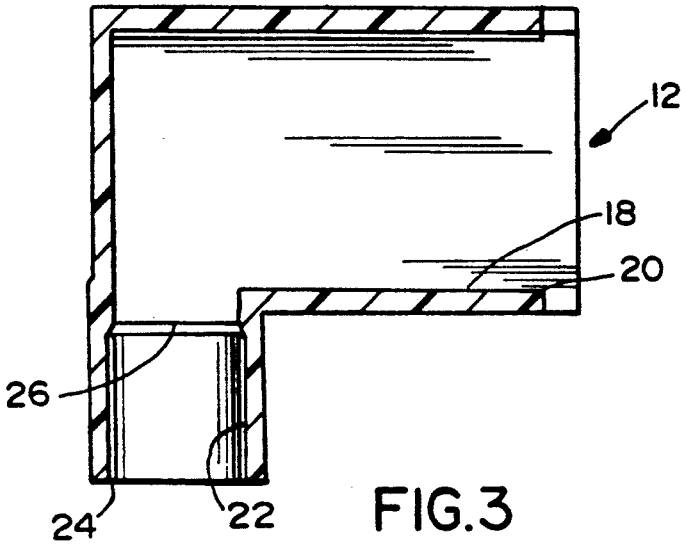
FIG. 3 is a section through the angled insulating housing of the terminal.
Figure 4:
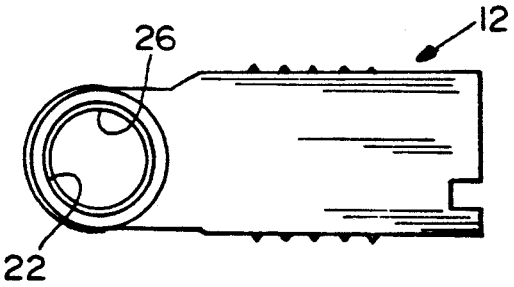
FIG. 4 is an end elevational view looking toward the front of FIG. 3.

Referring to FIGS. 2 and 3 in conjunction with FIG. 1, angled insulating housing 12 has a right-angled through passage, with a first passage portion 18 including an open end 20 for receiving the complementary mating terminal. The first passage portion communicates with, and is at a 90° angle to, a second passage portion 22 having an open end 24 for receiving the insulated electrical wire. The second passage portion has a slight reduced-diameter neck 26, as best seen in FIG. 3.

Figure 6:
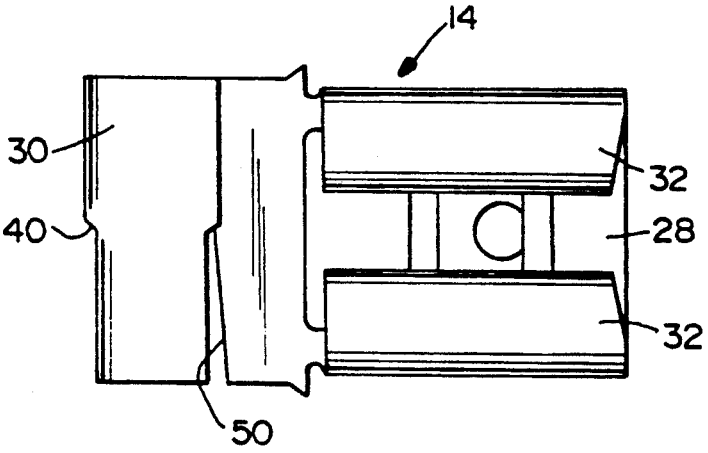
FIG. 6 is a top plan view of the terminal, itself, isolated from the insulating housing.
Figure 7:
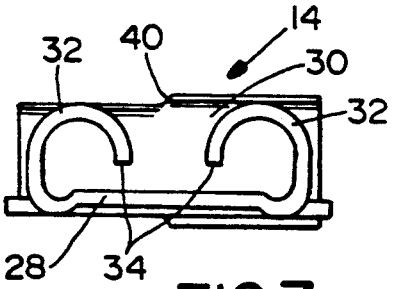
FIG. 7 is an end elevational view looking toward the right-hand end of FIG. 6.
Figure 8:
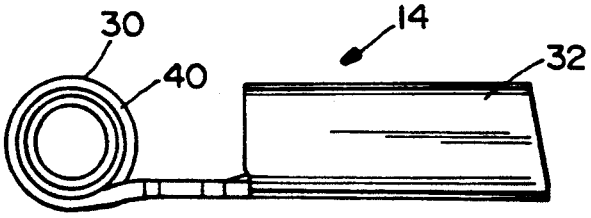
FIG. 8 is an end elevational view looking toward the front of FIG. 6.

Referring to FIGS. 6–8 in conjunction with FIG. 2, terminal 14 is positionable into first passage 18 of housing 12 through open end 20 of the passage in the direction of arrow "A". The terminal includes an outward contact section having a generally planar portion 28, and an inward crimp section 30 for crimping onto the exposed conductor core of the insulated electrical wire inserted through open end 24 of second passage portion 22. The contact section of terminal 14 is formed as a receptacle, with curled flanges 32 along opposite side edges planar portion 28, for receiving a complementary flat mating terminal tab. Specifically, looking at FIG. 7, the complementary mating terminal tab would be inserted into the contact section overlying planar portion 28 and beneath down turned edges 34 of curled flanges 32, whereby the flanges resiliently hold the terminal tab in terminating condition.

Crimp section 30 is generally tubular, as seen best in FIG. 8, for receiving the stripped conductor core of the insulated electrical wire. As seen best in FIG. 6, the crimp section has a reduced diameter area defining a neck 40, for purposes described hereinafter.

Figure 5:
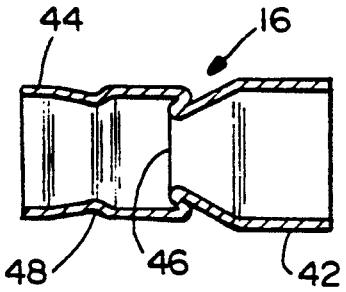
FIG. 5 is a section through the crimp ferrule for the wire insulation of the insulated electrical wire.

Referring to FIG. 5 in conjunction with FIGS. 2 and 6, crimp ferrule 16 is generally tubular in configuration and includes an outer tubular portion 42 and an inner tubular portion 44, with a folded area defining an internal annular shoulder 46. In addition, inner tubular portion 44 is indented, annularly thereabout, as at 48.

The method of assembling insulated terminal 10 now will be described. First, terminal 14 is inserted into first passage portion 18 of insulating housing 12, in the direction of arrow "A", to the position shown in FIG. 2 wherein crimp section 30 is aligned with second passage portion 22. Crimp ferrule 16 then is inserted into the second passage portion in the direction of arrow "B" such that inner tubular portion 44 of the crimp ferrule telescopes over the reduced diameter portion of crimp section 30. The crimp ferrule is inserted until the inner end thereof abuts neck 40 of crimp section 30 of the terminal, shoulder 46 abuts the end of the crimp section and outer tubular portion 42 abuts neck 26 within the second passage portion of insulating housing 12. Indented section 48 of the crimp ferrule grips the crimp section of the terminal sufficiently to hold the crimp ferrule telescoped over the crimp section until a subsequent crimping operation. It can be seen in FIG. 6 that a slot or relieved area 50 is provided in terminal 14 alongside crimp section 30 to allow crimp ferrule 16 to be telescoped over the crimp section. The insulated terminal now is in its preassembled condition ready to be crimped to an insulated electrical wire.

When it is desired to use insulated terminal 10, an insulated electrical wire, having an exposed or stripped end of the conductor core projecting from the wire insulation, is inserted into open end 24 of second passage portion 22 of insulating housing 12, through crimp ferrule 16 and into crimp section 30 of terminal 14. The stripped conductor core will project substantially into crimp section 30, and a portion of the wire insulation adjacent the stripped conductor core will be located within crimp ferrule 16 outwardly of crimp section 30. In other words, the end of the wire insulation will stop short of shoulder 46 defined in the crimp ferrule. In a single crimping operation, crimp section 30 of terminal 14 and crimp ferrule 16 can be crimped onto the insulated wire whereby the clamps or crimps onto the exposed end of the conductor core of the wire, and crimp ferrule 16 clamps or crimps onto the wire insulation adjacent the exposed conductor core to provide strain relief for the termination. It can be seen that the entire terminal (14), crimp ferrule (16) and the exposed end of the conductor core of the wire are completely enclosed by insulating housing 12. There are no open side walls in the terminal other than the opened ends required for the insertion of the mating wire and terminal. The terminal has a low profile, and the crimping functions on the conductor core and on the wire insulation of the electrical wire may be carried out in a single crimping operation.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an insulated terminal for connection to an end of an insulated electrical wire having an exposed conductor core projecting from the insulation, said terminal including:

an angled insulating housing having a through passage defined by a first passage portion communicating with and at an angle to a second passage portion, the first passage portion including a first open end through which a complementary mating terminal is received and the second passage portion including a second open end for receiving the insulated electrical wire;

a terminal portion positionable into the first passage portion through the first open end, the terminal portion including an outward contact section for direct connection to the mating terminal and an inward crimp section for crimping directly onto the conductor core of the insulated electrical wire inserted into the second passage portion; and an open-ended cylindrical crimp ferrule having one end adjacent the inward crimp section of the terminal portion and the other end adjacent said second open end, said crimp ferrule adapted to receive the insulated electrical wire therethrough such that said exposed conductor core is positionable within said inward crimp section and an insulated portion of the wire adjacent the exposed conductor core is positionable within the crimp ferrule adjacent said second open end, said housing being deformable whereby the inward crimp section of the terminal portion is adapted to be crimped directly about said exposed conductor core and the crimp ferrule is adapted to be crimped directly about said insulated portion of the wire by applying a crimping force to said housing;

wherein the improvement comprises:

said crimp ferrule being separate from said terminal portion and being receivable through said second open end of the second passage portion of the housing, and said housing substantially enclosing said terminal and said crimp ferrule except at said first and second open ends.

2. In an insulated terminal as set forth in claim 1, including complementary interengaging means between the crimp ferrule and the crimp section of the terminal portion for fixing the crimp ferrule to the crimp section.

3. In an insulated terminal as set forth in claim 2, wherein said complementary interengaging means comprise telescoped portions of the crimp ferrule and crimp section.

4. In an insulated terminal as set forth in claim 1, wherein said first and second passage portions extend at a right angle with respect to each other.

5. In an insulated terminal as set forth in claim 4, wherein said contact section of the terminal portion is generally flat with curled flanges along opposite side edges thereof for receiving a generally flat mating terminal through the second open end of the second passage.

6. In an insulated terminal as set forth in claim 5, wherein said crimp section of the terminal is generally tubular.

7. In an insulated terminal as set forth in claim 6, wherein said crimp ferrule and crimp section are interengaged by means of telescoped portions thereof.

8. A method of fabricating an insulated terminal for connection to an end of an insulated electrical wire having an exposed conductor core projecting from the insulation, wherein the insulated terminal includes an angled insulating housing having a through passage with a first passage portion communicating with and at an angle to a second passage portion, the first passage portion including a first open end for receiving a complementary mating terminal and the second passage portion including a second open end for receiving the end of the insulated electrical wire, the method comprising the steps of:

inserting a terminal portion into the first passage portion through the open end thereof, said terminal portion having an inner crimp section communicating with the second passage portion for crimping directly onto the exposed conductor core of the insulated electrical wire; and inserting an open-ended cylindrical crimp ferrule into the second passage portion through the second open end into engagement with and communicating with the crimp section of the terminal portion for crimping directly onto a portion of the wire insulation adjacent the exposed conductor core.

9. The method of claim 8, including the steps of:

inserting an insulated electrical wire into said second passage portion so that the exposed conductor core is located in said crimp section and the portion of the wire insulation adjacent the exposed conductor core is located in the crimp ferrule; and crimping the crimp section onto the exposed conductor core and crimping the crimp ferrule onto the portion of the wire insulation adjacent the exposed conductor core.

10. The method of claim 9, wherein said crimping of the crimp section onto the exposed conductor core of said insulated electrical wire and said crimping of the crimp ferrule onto the portion of the wire insulation adjacent the exposed conductor core is performed in a single operation.

11. In an electrical connector for connecting a blade-type terminal to an insulated wire having an exposed end, said connector including:

an integrally molded housing having a fully insulated blade-receiving passageway with a blade-receiving opening at one end and a fully-insulated wire-receiving passageway joining said blade receiving passageway generally at a right angle, said wire-receiving passageway having a wire-receiving opening at the other end; and a conductive blade-receiving terminal mounted in said blade-receiving passageway having one end matable with a blade terminal and the other end adapted to directly engage the exposed end of said insulated wire in said wire-receiving passageway, said housing being deformable whereby the wire-engaging end of the blade terminal is adapted to be crimped about said exposed end of said insulated wire by applying a crimping force to said housing;

the improvement comprising:

separate deformable strain relief means mounted in the wire-receiving passageway, mechanically and electrically joined to the wire-engaging end of the blade terminal, adapted to receive the exposed end of the insulated wire therethrough and substantially surround and engage the insulating portion of the wire adjacent the exposed end.

* * * * *